United States Patent [19]

Langenecker

[11] 4,292,826

[45] Oct. 6, 1981

[54] WIRE DRAWING APPARATUS EMPLOYING MACROSONIC TECHNIQUES

[76] Inventor: Bertwin Langenecker, 8253 Waldbach (Steiermark), Austria

[21] Appl. No.: 52,584

[22] Filed: Jun. 27, 1979

Related U.S. Application Data

[62] Division of Ser. No. 833,288, Sep. 14, 1977, abandoned.

[30] Foreign Application Priority Data

Sep. 16, 1976 [AT] Austria ..... 6865/76

[51] Int. Cl.[3] ..... B21C 9/00; B21C 3/10

[52] U.S. Cl. ..... 72/45; 72/56; 72/285; 72/709

[58] Field of Search ..... 72/DIG. 20, DIG. 29, 72/DIG. 31, 41, 43, 44, 45, 56, 57, 285

[56] References Cited

U.S. PATENT DOCUMENTS

| | | | |
|---|---|---|---|
| 2,638,207 | 5/1953 | Gutterman | 72/DIG. 20 |
| 3,212,312 | 10/1965 | Boyd et al. | 72/DIG. 20 |
| 3,212,313 | 10/1965 | Boyd et al. | 72/DIG. 20 |
| 3,526,115 | 9/1970 | Armstrong et al. | 72/45 |
| 3,740,990 | 6/1973 | Prasjnar et al. | 72/342 |
| 3,879,973 | 4/1975 | Godyn et al. | 72/41 X |
| 4,015,459 | 4/1977 | Winter et al. | 72/45 |

FOREIGN PATENT DOCUMENTS

| | | | |
|---|---|---|---|
| 37-1569 | 5/1962 | Japan | 72/DIG. 20 |
| 41-6448 | 4/1966 | Japan | 72/41 |
| 396139 | 1/1974 | U.S.S.R. | 72/DIG. 29 |
| 435028 | 11/1974 | U.S.S.R. | 72/DIG. 29 |
| 450610 | 5/1975 | U.S.S.R. | 72/DIG. 29 |

*Primary Examiner*—Ervin M. Combs
*Attorney, Agent, or Firm*—Toren, McGeady and Stanger

[57] ABSTRACT

A method and apparatus are disclosed for the drawing of wire-like elements, such as, wires, rods, tubes, and the like. The method employs the use of macrosonics for deformation of the wire. The use of hydrodynamic lubrication together with the macrosonic drawing process substantially increases the permissible drawing speeds. Apparatus for performing the method includes a horn having a drawing die and a properly dimensioned channel for permitting hydrodynamic lubrication disposed therein.

8 Claims, 2 Drawing Figures

WIRE DRAWING APPARATUS EMPLOYING MACROSONIC TECHNIQUES

This is a division of application Ser. No. 833,288, filed Sept. 14, 1977, abandoned.

FIELD OF THE INVENTION

The invention relates to a method and apparatus for the drawing of wires, rods, tubes, and the like, by means of macrosonics, to wit, ultrasonics of large amplitude, with the use of the hydrodynamic lubrication.

BACKGROUND OF THE PRIOR ART

It is known that the external tensile stresses or compressive stresses necessary for maintaining the plastic deformation of metallic materials can be significantly reduced by macrosonics of sufficiently large intensity. See the following literature: F. Blaha and B. Langenecker "Dehnung von Zink-Kristallen unter Ultraschalleinwirkung"; die Naturwissenschaften, 20, 556 and 557 (1955) and B. Langenecker, C. W. Fountain and V. O. Jones, "Ultrasonics: An Aid to Metal Forming?"; Metal Progress (1964). This fact opens up possibilities of use in the metal working industry. Several patented methods and devices are based on this effect of the reduction or decrease of the external forming forces by ultrasonics acting on the material (see U.S. Pat. Nos. 2,638,207, No. 2,568,303 and Austrian Pat. No. 246,082). These patents, in turn, in their conception, go back to the arrangement disclosed in the aforementioned publications.

The ultrasonics which comes into action is generated in a converter (transducer) by transforming electrical signals into mechanical oscillations and is amplified in a horn which oscillates in the direction of its longitudinal axis. As a rule, the drawing die is arranged in one of the displacement antinode of the ultrasonically oscillating horn, where the deformation of the wire takes place. In the following, the term wire also means rods, tubes, pipes, profile wire and the like. Only in Austrian Pat. No. 246,082 is the drawing die (nozzle) arranged in the nodal point, that is, in the stress antinode of the horn which is exited to a standing ultrasonic wave.

All these and similar methods and arrangements are only particularly effective at drawing speeds which are not larger than about the velocity of particle displacement. The term velocity of particle displacement v, of a sound field refers to the periodically changing velocity of the oscillating particles with reference to space and time. This velocity is measured in the usual speed dimension:

$$v = A \cdot \omega \cdot \cos \omega \left( t - \frac{x}{c} \right)$$

wherein A is the amplitude, $\omega$ is the angular frequency and c is the velocity of sound.

It follows that significant effects of macrosonics on the metal plasticity are rendered possible with the hitherto common frequencies of less than 100 kHz—usually 20 to 30 kHz—at drawing speeds below several meters per second. Since in industrial practice, materials which are difficult to deform, for example, molybdenum, tungsten, and others, are conventionally drawn substantially slower, without the use of macrosonics, than that corresponding to the velocity of particle displacement, in all these cases the activity of macrosonics according to the methods and devices referred to allows for significant possibilities for increasing the drawing velocities and also renders it substantially possible to increase the area reduction per drawing stage, as compared to the hitherto common conventional wire drawing procedures. In this manner, the productivity of the ordinary common wire drawing procedures is significantly increased.

Moreover, it is also possible to produce wires from such materials which, with the presently common conventional methods, either cannot be drawn at all or can be drawn only by also supplying heat (by heating the wire). The heating of the wires, however, results in the fact that the characteristics of the material may be negatively influenced by the thermal effect and this makes it sometimes necessary to perform a suitable after-treatment in order to again obtain or to attain the desired characteristics of the wire.

The macrosonic drawing procedure also permits the heating of such wires made of materials which cannot be drawn at all at room temperature or only can be drawn with great difficulty, so that it is then possible with the action of macrosonics to draw at room temperature. With several materials, for example, highly alloyed steel wires, the otherwise necessary chemical pre- and post-treatments can be dispensed with, which treatments are otherwise necessary for protecting the material with respect to the thermal treatment, or which have to be used in conventional procedures if the lubricant does not adhere to the material as soon as the wire is drawn through the drawing nozzle. The macrosonic procedure thus offers, in addition to increase of productivity, savings in that heating and chemical pre- and post-treatments can be dispensed with when compared with the conventional processes. This applies, for example, to the treatment referred to as "bonderizing".

The above statements, in the sense of the above-mentioned limitation of the velocity of particle displacement, relate to deformation speeds which are below several meters per second. With increasing deformation speed, to wit, if one, from a magnitude point of view, deforms in a manner equal to the size of the velocity of particle displacement, and still more rapidly, then the above-mentioned effect of the macrosonics decreases appreciatively on the metal plasticity until this effect finally, at very high speeds, disappears entirely.

SUMMARY OF THE PRESENT INVENTION

In accordance with the present invention, in a method for the drawing of wire-like elements, such as, wires, rods, pipes and the like, by means of drawing nozzles employing the use of macrosonics, the improvement comprising the step of hydrodynamically lubricating the drawing nozzle.

Also in accordance with the present invention, apparatus for the drawing of wire-like elements, such as, wires, rods, pipes and the like, employing macrosonics and hydrodynamic lubrication comprises means for supplying a wire-like element for drawing, an ultrasonic transducer, and a horn responsive to the ultrasonic transducer for amplifying the ultrasonic waves, the wire-like element being passed along a longitudinal axis of the horn. Also included is a drawing die arranged in the displacement antinode of the horn. The horn has a channel of predetermined diameter arranged before the drawing die with respect to the drawing direction, the channel diameter selected to be sufficiently larger than the diameter of the wire-like element ahead of the drawing die to assure hydrodynamic lubrication. Means for supplying a source of lubrication to the channel are also included.

It is an object of the present invention to provide a method and apparatus for drawing of wire using macrosonic techniques which are not speed limited.

It is another object of the present invention to provide a method and apparatus for the drawing of wire using macrosonic techniques which provide easy adaptation to industrial use.

It is a further object of the present invention to provide a method and apparatus for the drawing of the wire using the synergistic combination of macrosonic techniques and hydrodynamic lubrication.

For a better understanding of the present invention, reference will be made to the following description and accompanying drawing while the scope of the invention will be pointed out in the appended claims.

DETAILED DESCRIPTION OF THE INVENTION

Figure 1:
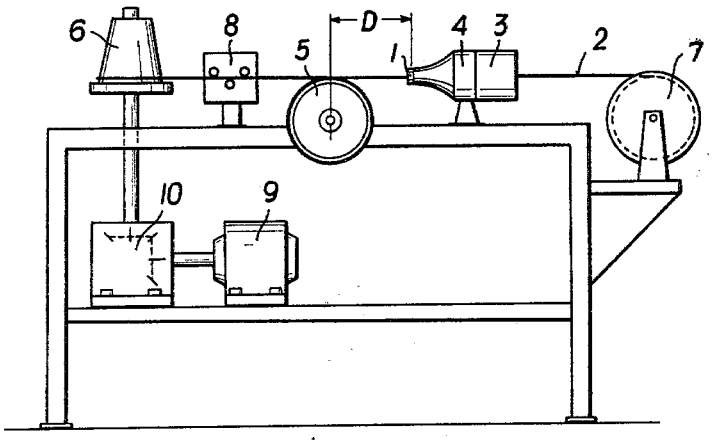
FIG. 1 is a schematic representation of the overall drawing method and apparatus for use with the present invention.

The principle of the inventive method and device is explained with reference to FIG. 1. The drawing die 1 is arranged perpendicular to the longitudinal axis of the wire and is thus more or less slanted relative to the longitudinal axis of the system, i.e., that of converter 3 (ultrasonic transducer) and the horn 4 which amplifies the ultrasonic waves (see U.S. Pat. Nos. 3,212,312 and 2,638,207). In these and similar known ultrasonic procedures, the wire 2 to be deformed passes through the entire acoustical system along the longitudinal axis. Even with compact construction, the structural elements dimensioned for frequencies of about 20 to 40 kHz have a length of 25 to 50 cm which is based on the wave length $\lambda = c/u$ of the ultrasonic field which is arranged in the usual manner. Since, moreover, the necessary lubricant may gradually block the channel in the longitudinal axis of the acoustical system through which the wire is passed through, the system is damped (which system in its natural frequency is excited to freely swing or oscillate) and thus, the beneficial qualities of the swinging or oscillating system are reduced which, in turn, leads to waste of ultrasonic energy. This is so because the resonance curve of the oscillating system is flattened and thus the effect or output of the system is reduced. Moreover, the lubricant may cause a short circuit in the interior of the converter 3 between the electrodes so that the system becomes nonfunctional.

It is of advantage to arrange a reflector roll 5 at the distance D from the drawing die, at which the wire to be drawn engages tightly or around the complete circumference of the reflector roll. The distance D is then preferably a multiple of half of the wave length of the used ultrasonic field. Instead of the reflector roll, a second drawing die may be arranged in the distance D whereby the same effect is obtained, namely, the formation of standing waves.

The wire which is to be drawn off from the supply spool 7 is guided by the reflector roll 5 to the drawing dish 6 (capstan). The latter, by way of the motor 9, is driven through a suitable gearing 10. If one wants to measure the forces which occur during the deformation, it is recommended to arrange a tensile stress measuring box 8 between the reflector roll 5 and the drawing dish 6.

The inventive procedure eliminates the repeatedly mentioned speed limitation for the deformation and thus opens up the unlimited use of the desired effects of macrosonics up to the highest deformation speeds which at present can be practically used for the deformation of wire, pipe and rod production. The inventive procedure is based on the structural arrangement explained in relation to FIG. 1, however, with the essential and decisive difference in the constructions, in the arrangement and thus also in the function of the component elements: drawing die 1, converter 3, horn 4 and reflecting plane in the distance D, which, in FIG. 1, has been indicated as the distance from the reflecting roll 5 or by arranging a second drawing die at the distance D. The inventive novel component elements are to be arranged ahead of the drawing dish 6 (or ahead of another suitable drawing arrangement instead of drawing dish 6) and also ahead of a tensile force-measuring device 8 which, if desired, may be used, and thus after or behind the supply spool 7. The inventive arrangement is described in more detail with reference to FIG. 2.

In accordance with the invention, the essential feature resides in the combination of the activation of deforming processes by ultrasonic action in the sense of the effects described in the introduction of this application, with hydrodynamic lubrication. This kind of lubrication has been known for some time and is, for example, used in the lubrication of bearings; the driver of a motor car is familiar with the physical effects of such hydrodynamic lubrication by a similar phenomenon called "aqua-planing" which occurs when one drives on wet surfaces with increased speed.

It is characteristic for this type of lubrication that it only comes into play with increased relative speeds, for example, of a wire relative to the wall of a narrow tube (having a bore which is not much larger than the diameter of the wire). The hydrodynamic lubrication comes into existence so that the lubricant adheres, on the one hand, to the wire and, on the other hand, to the inner wall of the tube. Due to the relative movement of wire and tube, shearing forces occur in the lubricant. These shearing forces ultimately produce pressure forces which are sufficiently large so as to press or urge the lubricant into the deformation zone (for example, the drawing die), which also occurs at high drawing speeds without rupturing the lubricating film. Without this hydrodynamic effect, lubricant films may rupture at high speeds and be ground down in the drawing dies, thus causing operational difficulties. The hydrodynamic lubricating effect thus assures deformation intensities at high deformation speed with little wear of the drawing tools.

Without the use of macrosonics, such lubricant effects can, however, only be utilized if corresponding high pressure pumps are used for starting up the procedure. This is so because the hydrodynamic effect presupposes a relatively high minimum deformation speed (drawing speed). By means of high pressure pumps, the high lubricant pressure must thus first be produced or generated, if one wants to start up such a drawing plant and since the high pressure pumps are expensive and voluminous, high pressure pumps require a correspondingly great expenditure with respect to costs, maintenance and service. This is so because pressures up to 10,000 atmospheres are necessary and corresponding pump plants are thus required.

By contrast, with macrosonics, the start-up from an inoperative position can be accomplished particularly effectively. Since, moreover, the starting up peak which would adjust itself even with the previously mentioned high pressure pumping arrangements, can be significantly reduced by the action of ultrasonics, it is possible to start up from the very beginning with substantially larger area reductions. With increasing speed, thus, when one, from a magnitude point of view, is in the range of the above-mentioned velocity of particle displacement, the effect of the macrosonics on the metal plasticity decreases.

At the same time, the effect of the hydrodynamic lubrication increases by itself. By suitably dimensioning the inlet channels which, in accordance with the invention are arranged ahead of the drawing die, and which in accordance with the invention are situated within the ultrasonic system, a continuous transfer or transition of the dominating role of macrosonic effect to hydrodynamic lubricating effect can be obtained. The inventive structural arrangement is now explained in relation to FIG. 2.

Figure 2:
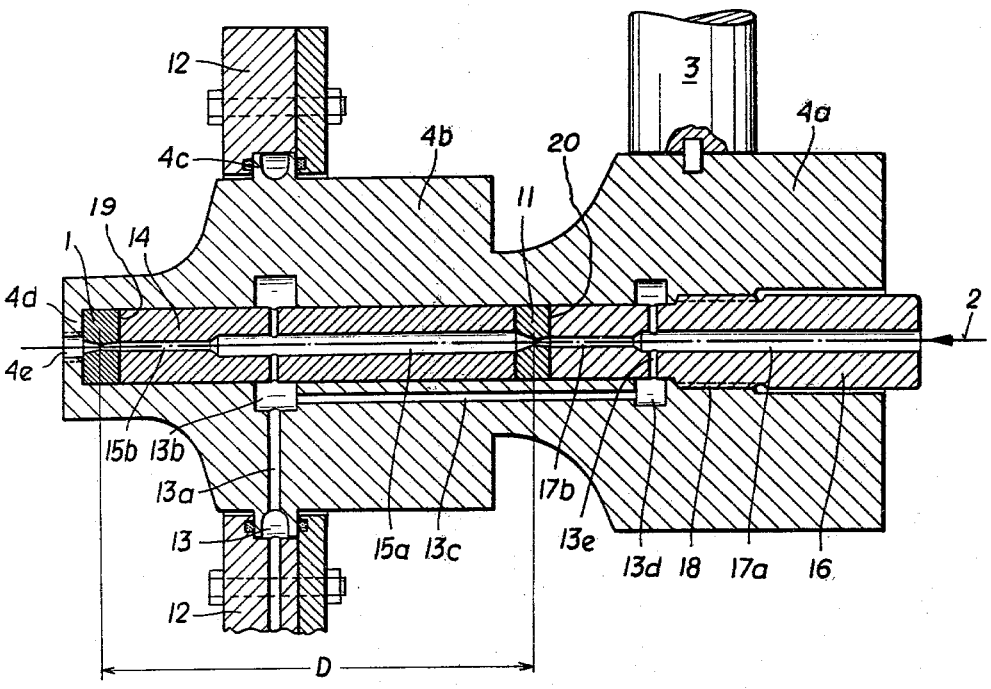
FIG. 2 is a cross-sectional view of the hydrodynamically lubricated horn of the present invention.

The wire 2 is deformed in the drawing die 1. The wire 2, seen in the view of FIG. 2, is drawn from the right towards the left. In doing so, the drawing die 1 performs ultrasonic oscillations in the drawing direction. These oscillations emanate from the converter 3 and are turned in their longitudinal expansion direction in the first portion 4*a* of the horn system about 90°. Thus, also the second portion 4*b* of the horn system oscillates in the direction of the longitudinal axis of the wire 2, so that the drawing die 1 which is situated at the displacement antinode of the horn system portion 4*b* takes part in the mentioned oscillations. The horn system, which, when observed perpendicular to the plane of the drawing, has a smaller thickness than in the plane of the drawing, comprises a holding or mounting ring 4*c* which is held in the flanges 12 and thus can be fastened or secured at the drawing machine. The lubricant is supplied through the flange. The lubricant is guided through the opening 13 and through the channels 13*a* and 13*b* to the wire 2 which wire passes through the thick-walled tube 14 towards the drawing die 1 at the place where the lubricant reaches into the interior of the tube 14 and thus reaches the wire 2 (this is the region of the displacement node of the horn system). For use as lubricant in the inventive method, known lubricants, such as, liquid (oil based) lubes may be employed.

The pipe 14 has an end face 19 as shown in FIG. 2 which completely contacts the adjacent rear end face of die 1 to prevent lubricant from acting on said end faces and a relatively large bore 15*a* whose diameter may amount to a multiple of the diameter of the wire. Only in the region 15*b* of the tube 14 is the inner diameter only slightly larger (several tenths of a millimeter) than the diameter of the wire 2. Thus, the hydrodynamic effect sets in here. This effect leads to the observation that with increasing drawing speed, the pressure increases with which the lubricant is pressed into the deforming zone of the drawing die 1.

In order to create the "standing wave" which has been required as explained in FIG. 1, one may, either completely analogous to the explanations of FIG. 1, arrange at the distance D a deflecting roller outside of the horn system of FIG. 2, or one may arrange a second drawing die, or one may, in accordance with the invention, arrange a second drawing die 11 within the horn system shown in FIG. 2 at the distance D. The distance D contains the pipe 14 which, of course, has to correspond, for different materials which can be drawn and adopted to the above acoustic conditions, to wit, the wave length λ of the materials to be drawn.

In accordance with the invention, it is feasible to introduce a pipe 16 also ahead of the second drawing die 11 which pipe 16 again first has a wide inner bore 17*a* and thereafter, in the vicinity of the drawing die 11, has this narrow inner bore 17*b* which leads to the described hydrodynamic lubricating effect ahead of the second drawing die 11. The lubricant may be supplied separately from the lubricant supplied to the drawing die 1, that means, also ahead of the inlet into the horn system shown in FIG. 2. However, in accordance with the invention, it is also possible to transport the lubricant through the channel 13*c* into the space 13*d* from whence the lubricant, through radial bores 13*e* in the pipe 16 enters the mentioned inner bores 17*a* and 17*b*. Further, end face 20 of pipe 16 completely contacts the adjacent rear end face of die 11 to prevent lubricant from acting on said end faces.

In order to convey the lubricant to the pipes 16 and 14, dependent on the viscosity of the lubricant, it is sufficient to have a slight excess pressure above atmospheric pressure. The hydrodynamic lubricating pressure effect comes into play independent of this conveying pressure due to the above-mentioned effects with corresponding dimensioning (length and width of the inner bore 15*b* and 17*b*).

The thread 18 should also be mentioned with which the pipe 16 is screwed so that it holds together the entire package consisting of drawing die 1 and drawing die 11 as well as the pipes 14 and 16, so that it presses against the exit or discharge 4*d* in the horn system portion 4*b*. The thread 18, by the way, may be advantageously arranged in the vicinity of the displacement node of the horn system.

Of course, it is feasible to eliminate the narrow inner bores 15*b* and 17*b* and thus to forego the hydrodynamic lubricating effect and to rely instead on the pure macrosonic effect. Also, for this purpose, the inventive horn system 4*a* and 4*b* constitutes a structural form which is superior to the prior art ultrasonic activation elements for drawing dies which assures not only amplification of the mechanical sound pressure amplitudes which emanates from the converter 3 but which also distinguishes itself by the particularly practical construction. The drawing die 1 or the drawing dies 1 and 11 can be easily assembled or put in and can be exchanged in a very easy manner. The distance D within the oscillating system is moreover provided with synchronous oscillations of the two drawing dies 1 and 11. Further, the inventive lubrication of both drawing dies is readily attainable and, moreover, the widening of the horn system 4*a* and 4*b* by screwing on additional ultrasonic building elements by means of thread 4*e* can be done, for example, if one wants to attach to this system an "in-line" ultrasonic cleaning system.

To create the standing wave, it is sufficient if the cross sectional reduction of the wire in the drawing die 11 is small or if the wire in this die is tightly guided. The distance D is dependent on the wave length of the used sound field while longitudinal oscillations or other oscillation components, such as, bending waves, transverse waves, expansion waves and the like can be provided.

While a specific embodiment of the invention has been shown and described in detail to illustrate the application of the inventive principles, it will be understood that the invention may be embodied otherwise without departing from such principles.

I claim:

1. Apparatus for the drawing of wire-like elements, such as, wires, rods, pipes and the like, employing macrosonics and hydrodynamic lubrication comprising:

means for supplying a wire-like element for drawing;

an ultrasonic transducer for generating ultrasonic waves;

a horn responsive to said ultrasonic transducer for amplifying the ultrasonic waves, said wire-like elements being passed along a longitudinal axis of the horn;

a pipe being disposed in said horn;

a drawing die arranged in the displacement antinode of the horn and extending substantially perpendicular to the drawing axis, said pipe having a channel of predetermined diameter arranged before the drawing die with respect to the drawing direction, said channel diameter being selected to be sufficiently larger than the diameter of the wire-like element ahead of the drawing die to assure hydrodynamic lubrication, said drawing die and pipe having respective end faces which closely and completely contact each other to prevent lubricant from acting on said end faces; and means for supplying a lubricant to said channel.

2. Apparatus as in claim 1 wherein the ultrasonic transducer generates a longitudinal macrosonic field and a second drawing die is arranged ahead of the first drawing die at a distance which is a multiple of half the wave length of the longitudinal macrosonic field, said horn including a second channel having appropriate dimensions for hydrodynamic lubrication, said lubrication supplying means also lubricating said second channel.

3. Apparatus as claimed in claim 1 wherein the pipe and drawing die is disposed in a common bore of the horn, the bore being open on one side.

4. Apparatus as claimed in claim 3 wherein the pipe is arranged in the horn by screw means provided in pipe and horn, the screw means being arranged in a displacement node of the pipe and horn.

5. Apparatus as in claim 1 wherein a reflector roll is arranged at a distance D from the drawing die, which distance D is a multiple of half of the wavelength of the longitudinal macrosonic field or other oscillation components.

6. A horn assembly for use in macrosonic drawing of wire-like elements comprising:

a horn element having a central bore open on one side, said bore having thread means disposed on inner walls thereof; and an insertable assembly including:

a drawing die having an end face; and a pipe having an end face, thread means disposed on outer walls thereof, and an internal channel, said drawing die end face and said pipe end face closely and completely contacting each other to prevent a lubricant from acting on said end faces;

said assembly being positioned and retained in said bore by the engagement of said bore and pipe thread means, said horn element also having lubricating passages which communicate with said internal channel of said pipe, said thread means of said horn element and pipe being arranged at a displacement node of the horn element and pipe.

7. Apparatus for the drawing of wire-like elements such as wires, rods, pipes and the like, employing macrosonics and hydrodynamic lubrication comprising:

means for supplying a wire-like element for drawing along a drawing axis;

means for supplying ultrasonic energy from a direction substantially 90° from the drawing axis;

a horn responsive to said ultrasonic energy for amplifying the ultrasonic waves, said drawing axis being arranged along an axis of said horn; and a drawing die arranged in the displacement antinode of the horn and extending substantially perpendicular to the drawing axis, said horn having a channel of predetermined diameter arranged before the drawing die with respect to the drawing direction, said channel diameter being a preselected size larger than the diameter of the drawing die to assure hydrodynamic lubrication.

8. Apparatus for the drawing of wire-like elements, such as wires, rods, pipes and the like, employing macrosonics and hydrodynamic lubrication comprising:

means for supplying a wire-like element for drawing along a drawing axis;

means for supplying ultrasonic energy;

a horn responsive to said ultrasonic energy for amplifying the ultrasonic waves, said drawing axis being arranged along an axis of said horn, said horn having an exit portion including an end retaining wall which is integral with said horn, said wall including an exit opening;

a drawing die arranged in the displacement antinode of the horn and extending substantially perpendicular to the drawing axis, said horn having a channel of predetermined diameter arranged before the drawing die with respect to the drawing direction, said channel diameter being a preselected size larger than the diameter of the drawing die to assure hydrodynamic lubrication, said wall exit opening having a diameter substantially smaller than the diameter of said die, said retaining wall preventing escape of said die from said horn resulting from hydrodynamic pressures being exerted on said die.

* * * * *